US006280023B1

(12) United States Patent
Ufkes

(10) Patent No.: US 6,280,023 B1
(45) **Date of Patent: *Aug. 28, 2001**

(54) CONTINUOUS INK-JET PRINTER AND METHOD OF OPERATION

(75) Inventor: Edsko Ufkes, Utrecht (NL)

(73) Assignee: Domino Printing Sciences PLC (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/011,348

(22) PCT Filed: Jul. 26, 1996

(86) PCT No.: PCT/GB96/01809

§ 371 Date: Jan. 28, 1998

§ 102(e) Date: Jan. 28, 1998

(87) PCT Pub. No.: WO97/06009

PCT Pub. Date: Feb. 20, 1997

(30) Foreign Application Priority Data

Aug. 4, 1995 (GB) ..... 9516052
Jun. 26, 1996 (GB) ..... 9613425

(51) Int. Cl.[7] ..... B41J 2/12

(52) U.S. Cl. ..... 347/78

(58) Field of Search ..... 347/76, 78, 80, 347/79

(56) References Cited

U.S. PATENT DOCUMENTS

| | | | | |
|---|---|---|---|---|
| 3,588,906 | * | 6/1971 | Brimer et al. | 347/14 |
| 3,916,421 | * | 10/1975 | Hertz | 347/73 |
| 4,216,480 | * | 8/1980 | Buehner et al. | 347/14 |
| 4,510,503 | * | 4/1985 | Paranjpe et al. | 347/14 |
| 4,551,731 | * | 11/1985 | Lewis et al. | 347/78 |
| 4,620,198 | * | 10/1986 | Behun | 347/43 |
| 4,670,761 | * | 6/1987 | Yoshino et al. | 347/14 |
| 4,809,016 | * | 2/1989 | Padalino | 347/41 |
| 4,864,323 | * | 9/1989 | Lecheheb et al. | 347/78 |
| 5,481,288 | * | 1/1996 | Keeling et al. | 347/80 |

* cited by examiner

*Primary Examiner*—N. Le
*Assistant Examiner*—Michael Nghiem
(74) *Attorney, Agent, or Firm*—Robert F. I. Conte; Lee, Mann, Smith, McWilliams, Sweeney & Ohlson

(57) ABSTRACT

A continuous ink-jet printing method in which a stream of droplets issue from a nozzle of a continuous ink-jet printhead and a print substrate is moved past the printhead. The deflection electrodes of the printhead being disposed at a preselected angle relative to the path of movement of said print substrate. In accordance with said deflection electrode angle, for each of a series of droplets to be printed on said substrate to form an image, the value of the charge to be applied to the droplet is determined. The speed of movement of the print substrate relative to the printhead is determined and the values of the charges to be applied to the droplets in said stream corrected and the number of uncharged droplets between printable droplets adjusted in accordance with the determined speed of the substrate before the respective charges are applied to each of the droplets for printing.

11 Claims, 10 Drawing Sheets

Fig. 2
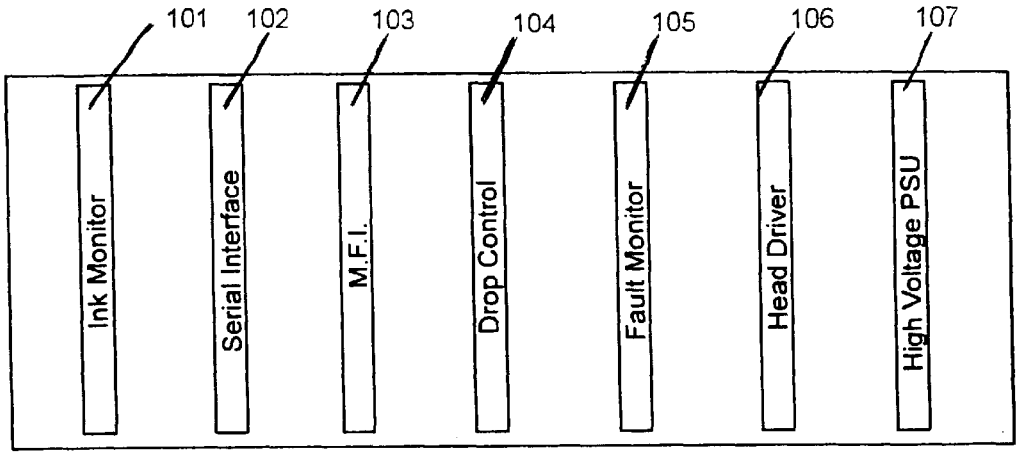
Fig. 3
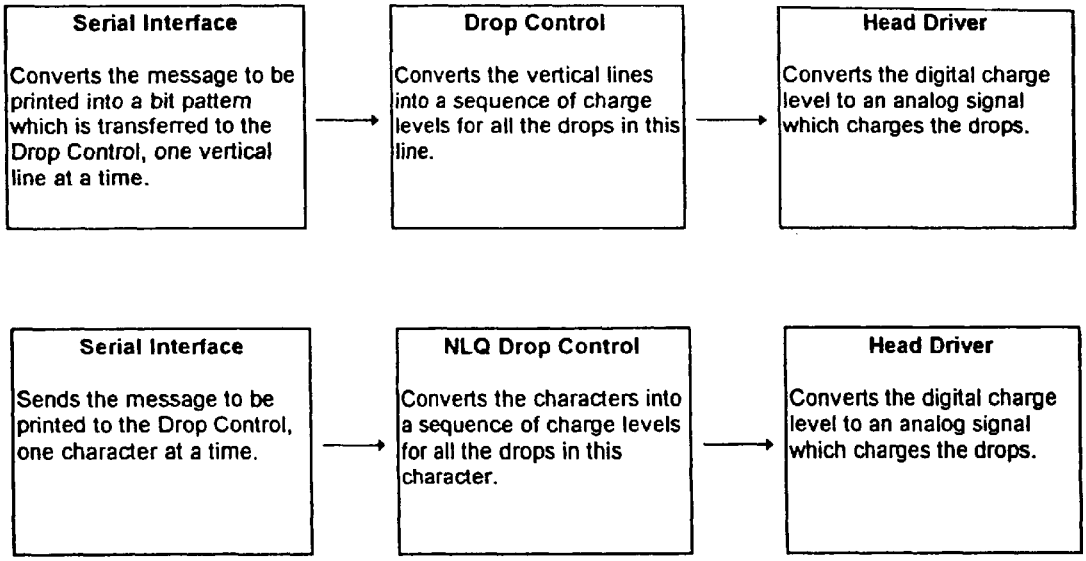
Fig. 4

CHARACTER:A
Dot Nr :1
Drop Nr :1
Voltage :30
NoOfDrops :24

01: 01 - 30
02: 03 - 52
03: 05 - 74
04: 07 - 96
05: 09 - 118
06: 11 - 140
07: 13 - 162
08: 16 - 96
09: 18 - 182
10: 25 - 96
11: 26 - 198
12: 34 - 96
13: 35 - 206
14: 43 - 96
15: 44 - 206
16: 46 - 30
17: 48 - 52
18: 50 - 74
19: 51 - 196
20: 52 - 96
21: 54 - 118
22: 55 - 180
23: 56 - 140
24: 58 - 162

CHARACTER:B
Dot Nr :1
Drop Nr :1
Voltage :30
NoOfDrops :28

01: 01 - 30
02: 03 - 52
03: 05 - 74
04: 07 - 96
05: 09 - 118
06: 10 - 30
07: 11 - 140
08: 13 - 162
09: 15 - 184
10: 17 - 206
11: 18 - 127
12: 19 - 30
13: 26 - 206
14: 27 - 127
15: 28 - 30
16: 35 - 206
17: 36 - 127
18: 37 - 33
19: 43 - 119
20: 44 - 206
21: 45 - 48
22: 46 - 139
23: 48 - 106
24: 49 - 67
25: 51 - 88
26: 52 - 198
27: 53 - 157
28: 54 - 178

Fig. 8
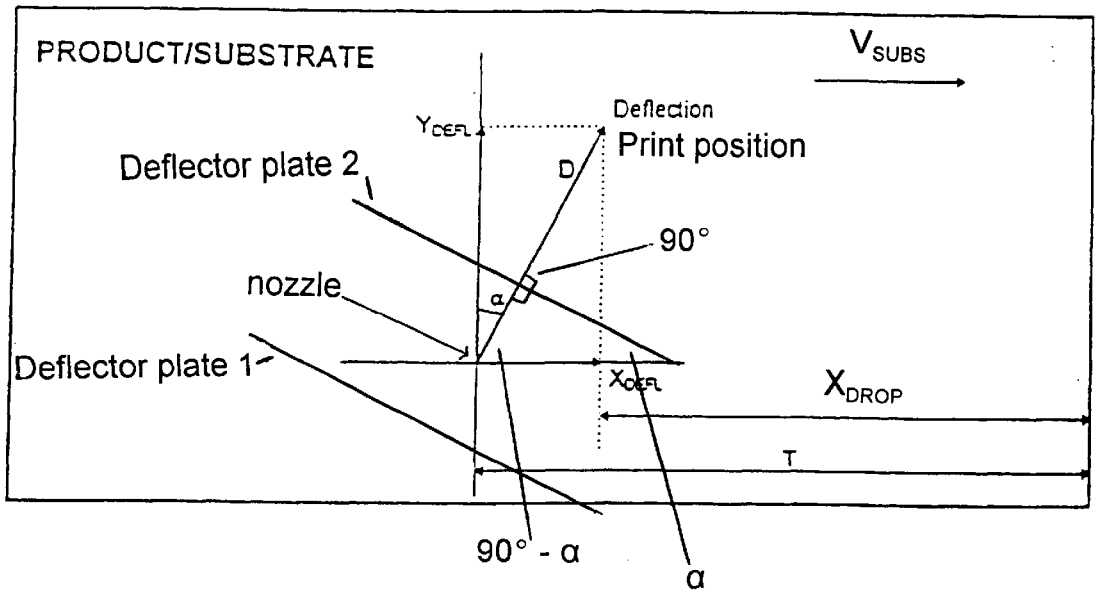
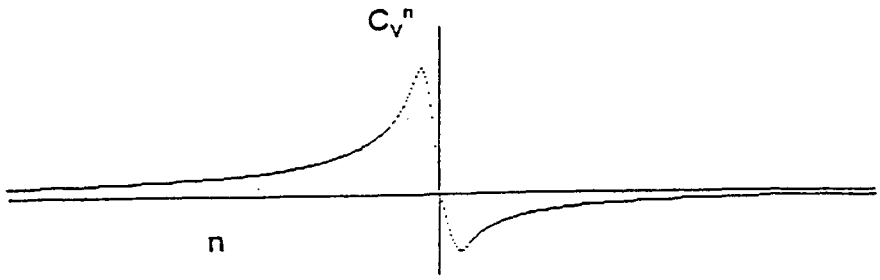
Fig. 10

CONTINUOUS INK-JET PRINTER AND METHOD OF OPERATION

FIELD OF THE INVENTION

The present invention relates to so-called 'continuous ink-jet' (CIJ) printers, in which lines of printed droplets are printed on to a substrate after having been electrostatically charged and then deflected in accordance with the charge level.

BACKGROUND OF THE INVENTION

In continuous ink-jet printers,each character of print is made up of plural lines of droplets which extend in a direction transverse to the direction of relative movement between the printer and the substrate. Each line is printed from a so-called 'raster' of droplets in which each printable droplet has a defined print position. Non-printable 'guard' droplets separate the printable droplets and the printable droplets are either printed or not, depending on the character being formed.

Whilst such printers are capable of printing at very high speeds (droplets may be generated at 64kHz or even 128kHz), a particular problem often exists with the quality of printing produced by such printers, particularly where they are being used to print, from a single nozzle, a wide variety of very different characters or different character fonts. The characters cannot readily be printed to 'near letter quality' (NLQ), unlike so-called 'drop-on-demand' (DOD) ink-jet printers which use an array of closely spaced nozzles, with ink droplets from plural nozzles being used to make up each line of each character. Often, the lines of characters are slightly sloped, which itself may be undesirable, but the more significant problem is simply that the droplet resolution is not sufficiently high to allow characters to be well and fully shaped.

There has long been a desire to overcome this problem and techniques involving the use of multiple CIJ printheads have been proposed as one solution to the problem. Whilst reasonable resolution may be achieved, the increased cost and complexity of such printers rarely makes their use viable, particularly in marking and coding applications.

U.S. Pat. No. 4,670,761 discloses a continuous ink-jet character printing method which comprises providing a stream of droplets from a nozzle of a continuous ink-jet printhead; moving a print substrate past the printhead, said printhead having a pair of deflection electrodes for deflecting individual charged droplets from said stream of droplets to a required print position on the substrate; determining the speed of movement of the print substrate relative to the printhead; said deflection electrodes being disposed at a preselected angle relative to the path of movement of said print substrate, wherein the droplets are charged in dependence upon the speed of the substrate relative to the printhead to determine their print position.

SUMMARY OF THE INVENTION

According to the present invention, the method includes determining, in accordance with said deflection electrode angle, for each of a series of droplets to be printed on said substrate to form an image, the value of the charge to be applied to the droplet;

correcting the values of the charges to be applied to the droplets in said stream and adjusting the number of uncharged droplets between printable droplets in accordance with the determined speed of the substrate; and applying the respective charges to each of the droplets in turn.

Effectively, therefore, the printer is operated in a non-raster or rasterless mode.

The term 'substrate' is used herein to refer to an article or plurality of articles on which characters or images are to be printed and the term 'character' herein refers to a discrete character, ideogram, image etc., and is not limited to simple alpha-numeric characters.

The invention also includes a continuous ink-jet printer comprising means for providing a stream of droplets from a nozzle of a continuous ink-jet printhead;

means for applying a charge to individual ones of the droplets;

a pair of deflection electrodes for deflecting individual charged droplets from the stream of droplets to a required print position on a substrate moving past the printhead, said deflection electrodes being disposed at a preselected angle relative to the path of movement of said substrate; and means for determining the speed of movement of the print substrate relative to the printhead; characterised by means for determining, in accordance with the deflection electrode angle, for each of a series of droplets to be printed on the substrate to form an image, the value of the charge to be applied to the droplet; and means for correcting the values of the charges to be applied to the droplets in the stream and adjusting the number of uncharged droplets between printable droplets in accordance with the determined speed of the substrate.

A look-up table or other memory may contain a vector representation of the position of the droplets forming each printable character and the charge to be applied to the droplets may be calculated after reading the vector representation by means of a suitable algorithm. The algorithm may be hard- or soft-coded into the apparatus. Alternatively, the look-up table or other memory may contain sets of charge values for each droplet of each character that the printer is enabled to print or, when printing multiple lines of characters, a voltage offset may be added to the calculated charging voltages depending on the line in which the respective character drop is to be printed.

Multiple lines of characters may be printed using individual look-up tables or memories for each line of print or else a large look-up table containing values for the characters to be printed in each line (thus the values for the same character to be printed on different lines will be different).

Preferably, the angle a of the deflection electrodes to the path of movement of the substrate is chosen depending on the number of droplets N required or selected to print a line normal to the path, by the equation:

$$\tan\alpha = \frac{n+1}{N}$$

where: n is the minimum number of non-printable droplets between adjacent printable droplets in a line of droplets normal to the path.

Furthermore, the determination of the speed of the substrate may be made by means of a suitable line speed sensor or else manually or the speed may be preset and the step of determining the speed may thus be achieved by setting the speed into the apparatus by means of a suitable manually adjustable input. In many applications, the articles or substrate pass beneath the printhead at a fixed speed determined by the packaging or other process with which the printing method is associated, but in other cases, a shaft encoder or similar means is used to determine the speed of movement of the substrate or articles in a process where their speed is variable according, say, to process conditions further upstream.

The correction of the values of the charges to be applied to the droplets in the stream may be carried out at one of a number of different stages in the process. For example, the charge values read from the look-up table or other memory may be corrected as the values are read therefrom or else corrections may be applied by a feedback method immediately prior to the charging signals being fed to the printhead. If multiple lines of characters are printed using individual look-up tables or memories for each line of print, then corrections may be applied after multiplexing of the look-up table values.

If the required print has no line that extends normal to the path of movement of the substrate, then a deflection electrode angle may be chosen to best suit the particular application.

An example of a CIJ printer operated according to the present invention, will now be described with reference to the accompany drawings, in which:

BRIEF DESCRIPTION OF THE DRAWINGS

FIG. 2 illustrates an arrangement of the electronics processing guards in such a printer;

FIG. 3 is a flowchart illustrating the conventional printing process used in such a printer;

FIG. 4 is a flowchart illustrating the printing process of the present invention;

FIG. 8 illustrates the principal behind the present invention;

FIG. 10 is a representation of an array of correction voltages used in correcting the voltages applied to the printed droplets in the two examples.

DETAILED DESCRIPTION OF THE INVENTION

Figure 1:
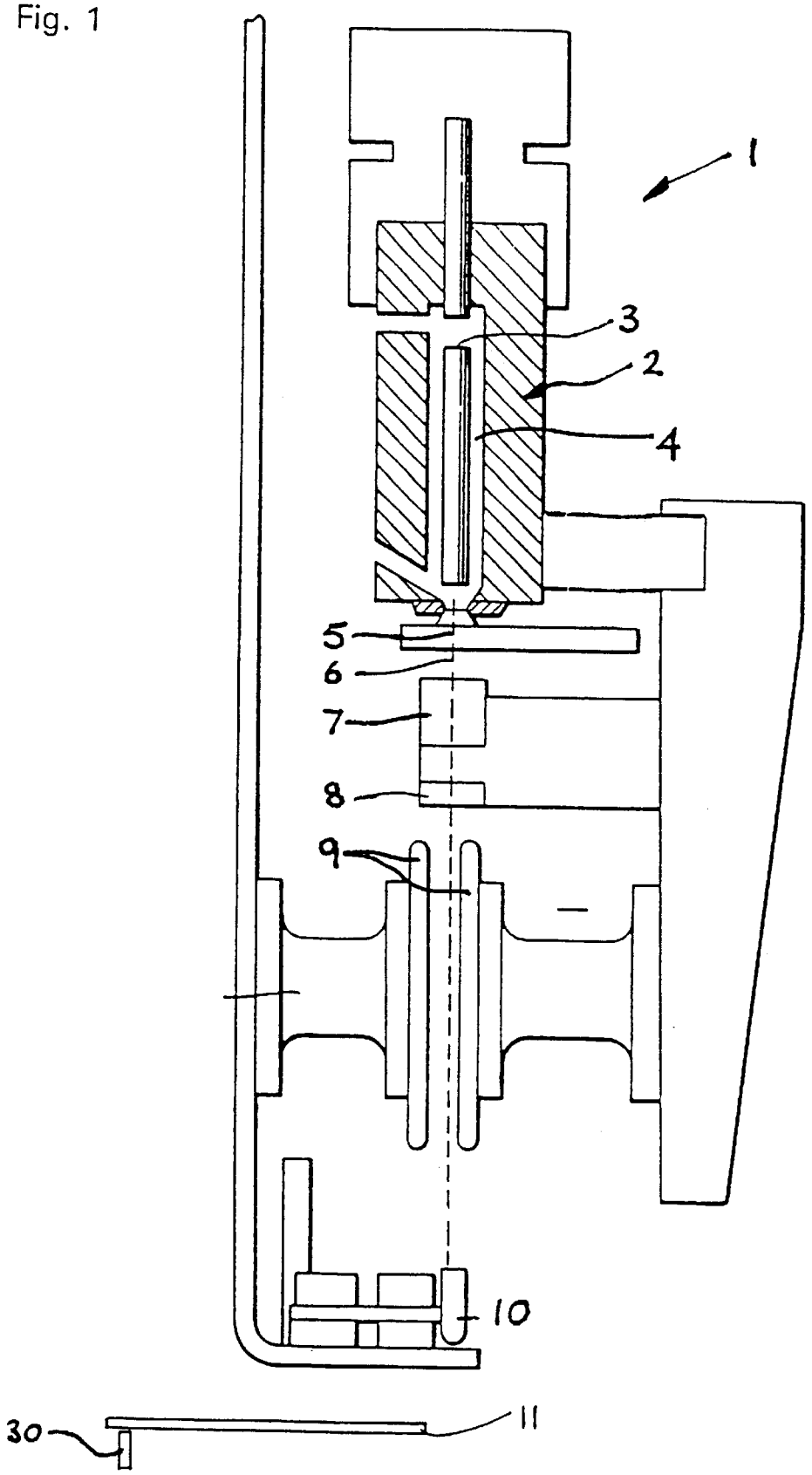
FIG. 1 is a diagram which illustrates a typical CIJ printhead in elevation.

The CIJ printhead 1 shown in FIG. 1 is conventional in the main and has a droplet generator 2 which incorporates a rod-like piezoelectric transducer/oscillator 3 disposed in a chamber 4 to which ink is fed from a reservoir (not shown). The ink is forced through a nozzle 5 and breaks up into a stream of droplets 6 under the operation of the transducer which may oscillate at say 64 kHz or 128 kHz. The droplets 6 pass a charging electrode 7, at which point appropriate charges are applied to the individual droplets in accordance with a suitable charging strategy determined by the characters to be printed and the number of characters in a vertical line of each character, and the droplets then pass a phase/charge detector electrode 8. The droplets are deflected (according to the degree of charge) when they pass between a pair of deflector electrodes 9. Uncharged, undeflected droplets pass to a gutter 10 from where ink is recirculated to the printhead. The deflected droplets impinge on a printing substrate 11 at positions dictated by their degree of deflection.

The electronics module (not shown in FIG. 1 but shown in FIG. 2) has plural printed circuit boards (pcbs) 101-107 which respectively provide the functions of ink supply monitoring, serial interface with the message generator, multi-function interface, droplet parameter generation, fault monitoring, printhead transducer driving, and high voltage power supply for the printhead.

As shown in the flowchart of FIG. 3, conventionally, the serial interface 102, once it has received a string of characters, whether they be human readable or not and hereinafter referred to as a message, to be printed, from a message generator (not shown), converts the message into a bit pattern which is transferred to the drop control board 104, one vertical line of the characters at a time. The drop control board 104 then converts the bit pattern into a sequence of charge values (to be applied to the droplets in the raster) for all the droplets in the respective vertical line. (Note that the term 'vertical line' is used to distinguish from individual messages to be printed on different lines of the substrate.) The droplet charge level values are supplied to the head driver board 106 which converts the digital values to analog signals which are then used in the printhead to charge the respective droplets.

The invention substitutes the drop control board 104 with a modified board 104'. The serial interface function is altered so that the message to be printed is sent to the drop control board 104' one character at a time and the drop control board 104' converts the characters into a sequence of charge level values for all the droplets to be used to make up the character. The head driver 106 operates in a conventional fashion.

Figure 5:
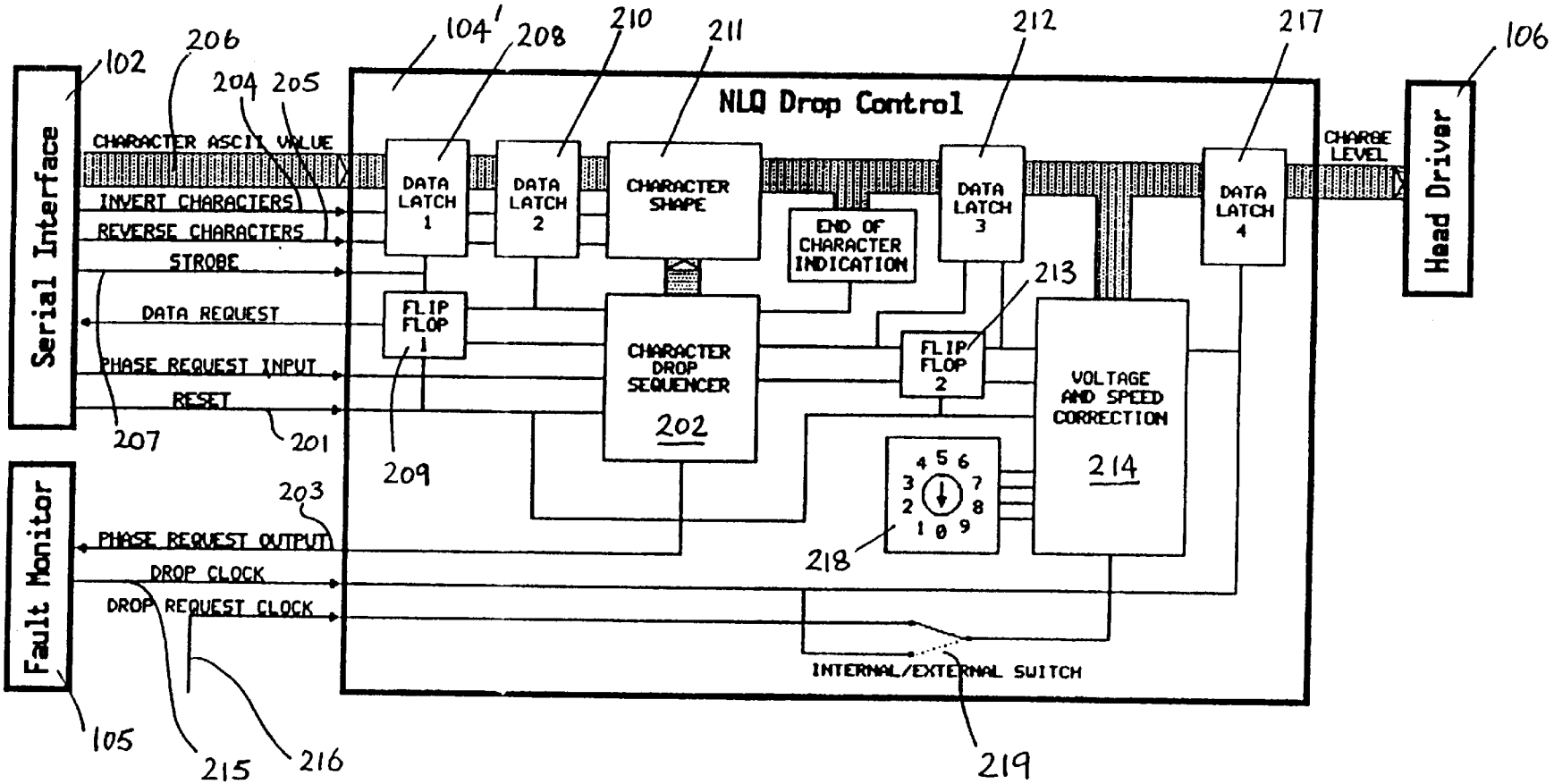
FIG. 5 is a circuit/block diagram of the drop control board used in the example.

The full sequence of operations for printing a message is as follows and can be appreciated from FIG. 5:

1. The serial interface 102 resets the phase request signal line 201 to indicate that a message will be printed.
2. The character drop sequencer 202 resets its phase request output 203 to stop the phasing process which is handled by the fault monitor 105.
3. The serial interface 102 adapts the invert characters 204 and reverse characters 205 signal lines to the current print direction.
4. The serial interface 102 puts the ASCII value of the character to be printed on the data bus 206.
5. The serial interface 102 outputs a pulse on the strobe line 207. This strobe will store the ASCII value and print direction in a datalatch 208. Also flip-flop 209 is reset to indicate that the serial interface should wait before sending the next character.
6. The state of flip-flop 209 is read by the character drop sequencer 202. When this state indicates that the serial interface has written data to latch 208, the contents are copied into latch 210 and at the same time flip-flop 209 is set to indicate to the serial interface 102 that the next character can be sent.
7. The character drop sequencer 202 resets its drop counter to zero causing the first drop data to be placed on the output bus of the character shape memory 211, which stores character data for all printable characters. This data is pre-stored on the board, but can be re-stored for a different character set for example, as required. If the data does not indicate the end of the character, the data is stored in latch 212 and at the same time flip-flop 213 is reset. When flip-flop 213 is reset, it indicates to the character drop sequencer 202 that it should wait before storing the next drop data and it indicates to the voltage and speed correction controller 214 that a drop can be read from the latch 212.

8. The voltage and speed correction controller 214 is connected to two clocks 215,216. One clock 215 is synchronised to the formation of the drops and is supplied by the fault monitor 105. For each drop the charge level output has to be determined. The other clock 216 is the drop request clock, which is an external signal, generated by a shaft encoder 30 (see FIG. 1) connected to the production line 31. On each pulse of this clock 216 a drop is read from latch 212 into the head driver 106 and then a correction value is added from voltage and speed correction controller 214 to correct for the interaction between drops before the data can be stored in latch 217. When the drop clock 215 indicates that the next drop charge level should be prepared, but the drop request clock 216 does not indicate the next drop, an additional unprinted drop is inserted into the sequence. When a drop is read from latch 212, flip-flop 213 is set to indicate to the character drop sequencer 202 that the next drop can be stored in latch 212.
9. The character drop sequencer 202 keeps storing data in latch 212 until the end of the character has been reached. When the end of the character has been reached, the next character is transferred from latch 208 to latch 210 and the process will continue. When the end of the message has been reached, the serial interface 102 does not put a new character in latch 208 and it will set the phase request signal 201. The character drop sequencer 202 will reset the phase request output 203 and stops storing data in latch 212.

The drop control pcb 104' includes a rotary switch 218 which can be used to select a division of the drop request clock from 1 to 10. An internal/external switch 219 enables a selection to be made between an external drop request clock proportional to the line speed (determined as described above), and an internal clock which will result in a fixed print speed.

Figure 6:
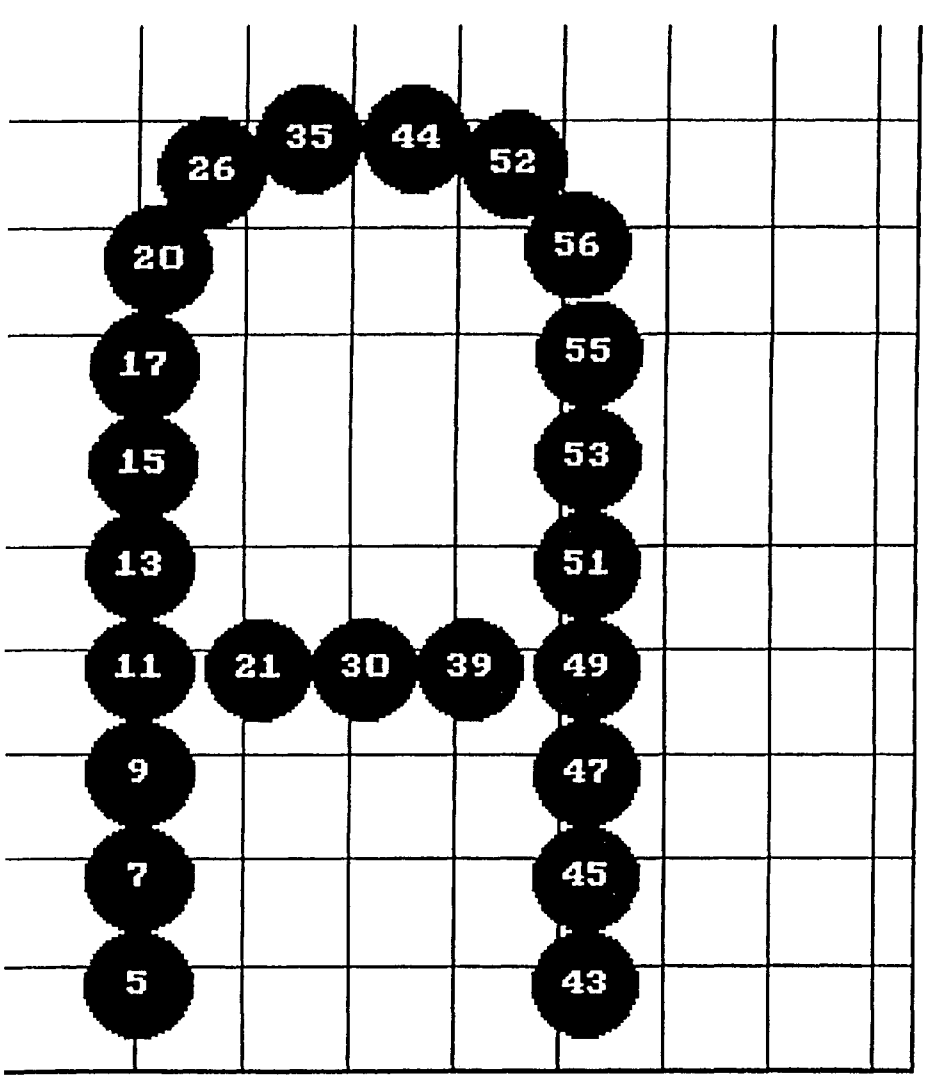
FIG. 6 is a diagram of the droplets used by the example printer of the invention to form the character 'A'.
Figure 7:
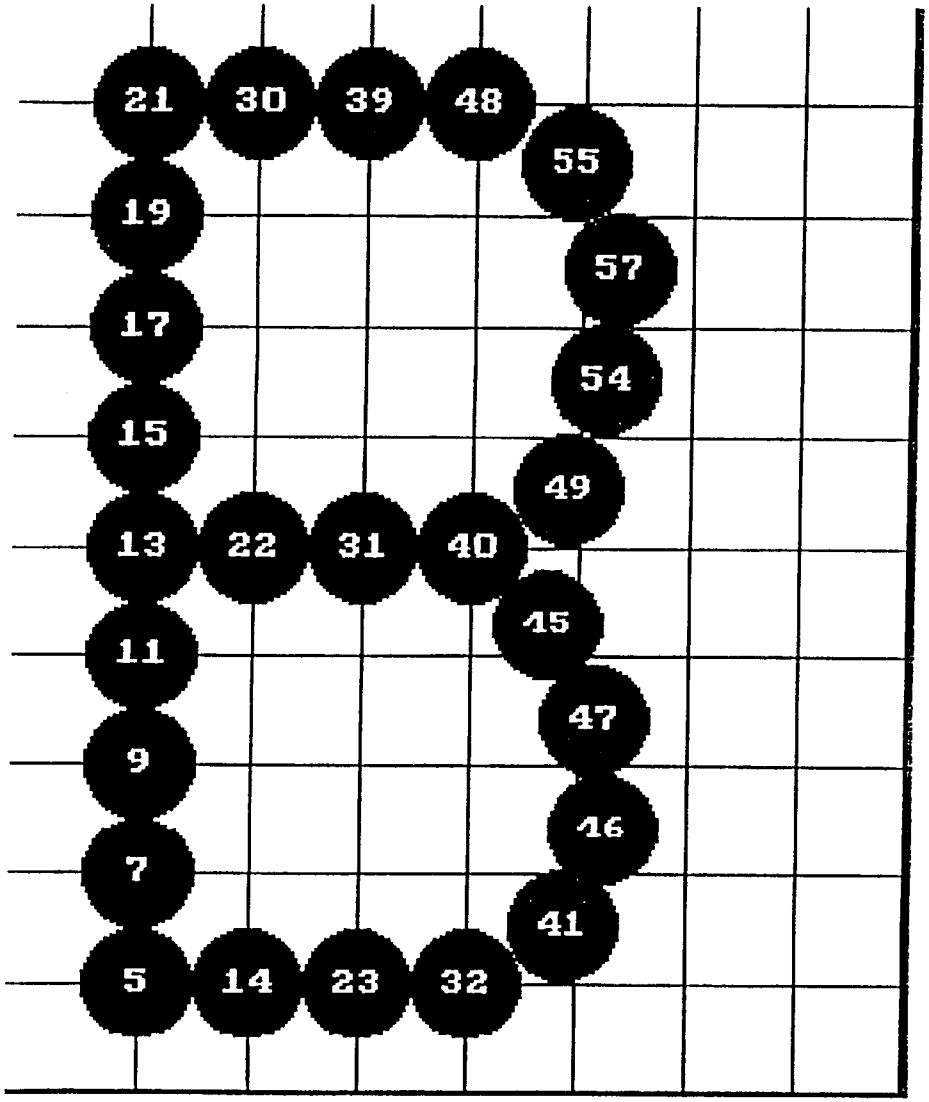
FIG. 7 is a diagram of the droplets used by the example printer of the invention to form the character 'B'.

Referring to FIGS. 6 & 7, the printed droplets for the characters A & B (of a chosen font or design) are shown in a method according to the invention, in which one guard droplet is provided between consecutive printable droplets in a line normal to the print direction. The table to the right of each figure lists, in the first column, the number of the droplet printed in the character, in the second column, the printable droplet number in the string and, in the third column, the charge value (in Volts) applied to the respective droplets as they pass past the charge electrode.

Referring to FIG. 8, which illustrates the principal behind the present invention, and where the speed of the product or substrate relative to the printhead is shown as $V_{SUBS}$, the print position of a droplet from a datum is shown as $X_{DROP}$, and the values of X & Y deflection from the nozzle position are $X_{DEFL}$ & $Y_{DEFL}$ respectively, then $$X_{DROP}=(V_{SUBS}*T)-X_{DEFL} \quad (2)$$

$$X_{DEFL}=D*\sin\alpha \quad (3)$$

$$Y_{DEFL}=D*\cos\alpha \quad (4)$$

Combining equations 2 to 4 gives the following relationship:

$$X_{DROP}=(V_{SUBS}*T)-(Y_{DEFL}*\tan\alpha)$$

Now, in a vertical line of printable drops, any number can be left out between consecutive printable drops (in order to provide suitable guard drops). Therefore, assuming that it is chosen to use alternate drops as printable drops (ie leaving one guard drop between each printable drop), then, since, for all drops in a printed vertical line $X_{DROP}$ is the same, the following relationship holds for two consecutive drops in a vertical line:

$$V_{SUBS}*T_2-Y_{DEFL2}*\tan\alpha=V_{SUBS}*T_1-Y_{DEFL1}*\tan\alpha$$

which leads to $$V_{SUBS}*(T_2-T_1(Y_{DEFL2}-Y_{DEFL1})*\tan\alpha$$

now, since $$Y_{DEFL2}-Y_{DEFL1}=D_{DROP}(\text{drop pitch})$$

and since $$T_2-T_1=2*T_{DROP}$$

(because every second drop is used), then:

$$V_{SUBS}*2*T_{DROP}=D_{DROP}*\tan\alpha$$

If there are N dots (drops printed) in a full height line, then the first dot of the next line is printed N dots later, and assuming that the horizontal dot pitch is equal to the vertical dot pitch, the following equation for substrate speed holds true:

$$V_{SUBS}=\frac{D_{DROP}}{2N*T_{DROP}}$$

and combining the two equations for substrate speed leads to $$\frac{D_{DROP}}{2N*T_{DROP}}*2*T_{DROP}=D_{DROP}*\tan\alpha$$

which, in turn, leads to:

$$\tan\alpha=\frac{1}{N}$$

Thus, the printhead angle is determined by the selected number N of droplets in a full vertical line of print. The equation evaluates as shown below in Table 1.

TABLE 1

| Drops | 5 | 6 | 7 | 8 | 9 | 10 | 11 | 12 |
|---|---|---|---|---|---|---|---|---|
| Angle | 21.8 | 18.4 | 16.9 | 14.0 | 12.5 | 11.3 | 10.3 | 9.5 |

A second example of a method according to the invention uses the same basic printhead as described above in connection with the first example.

The serial interface function is altered so that the message to be printed is sent to the drop control board 104' and the drop control board 104' converts the characters into a sequence of charge level values for all the droplets to be used to make up the message. The head driver 106 operates in a conventional fashion.

Figure 9:
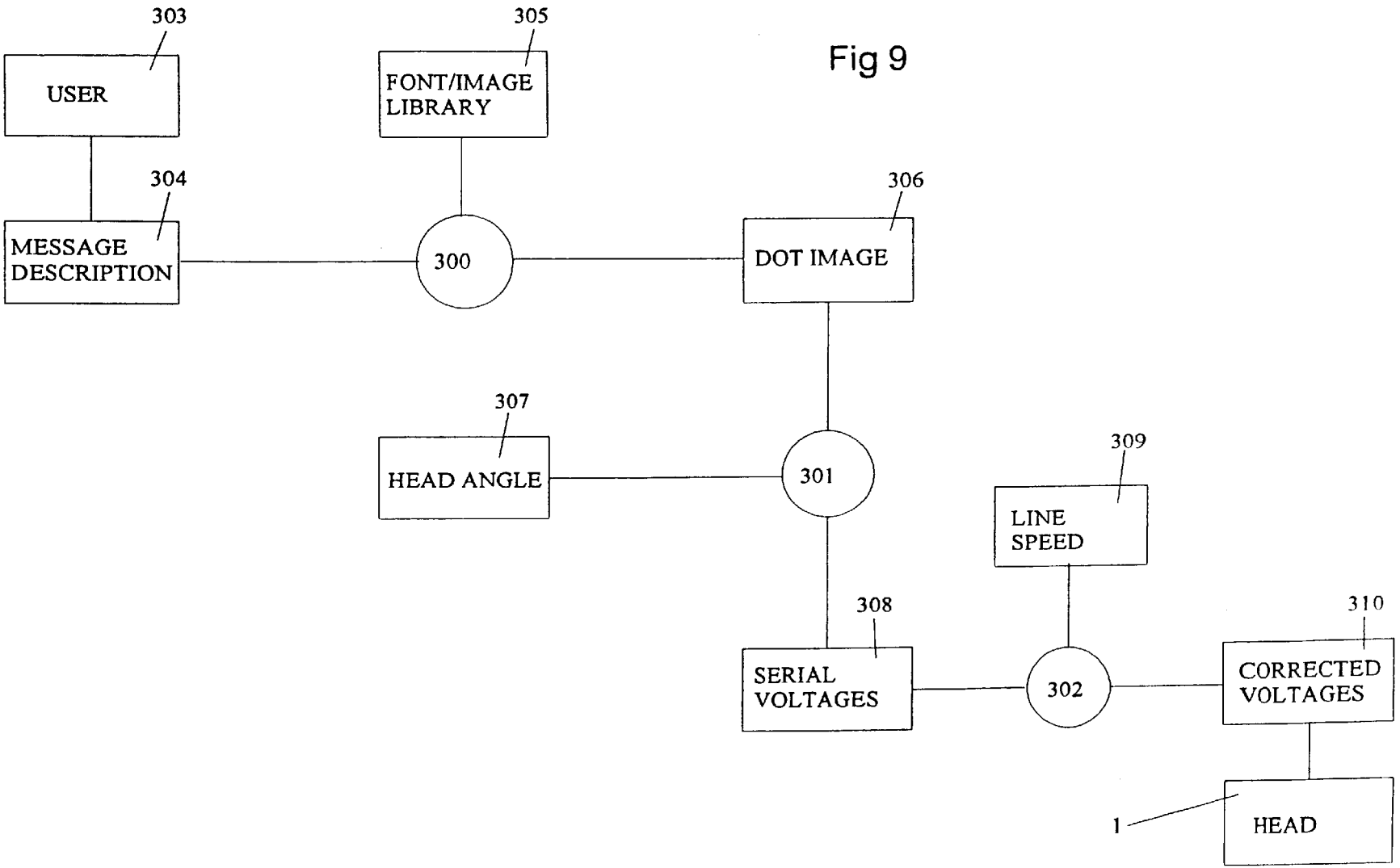
FIG. 9 is a flowchart illustrating the printing process of a second example according to the invention.

FIG. 9, which is a flowchart illustrating the printing process of the second example, illustrates a series of processing steps 300, 301, 302 to which various inputs are provided in order to carry out the process. Specifically, a user 303 enters, by way of a keyboard or the like a message description 304 into the printer and the printer processor, within the step 300, creates, by reference to a font/image library 305 containing image maps of the dot positions for representing individual characters or other indicia, a dot image map 306 representing the coordinate positions of all the drops necessary in order to print the message input by the user. In step 301 the processor determines the voltages to be applied serially to each droplet required to print the message, using as inputs the dot image map 306 and the head angle 307 (the angle of the deflection plates of the printer relative to the direction of the substrate path) and the serial voltages 308 thus calculated are then corrected by the processor in step 302 by reference to the line speed 309 (the speed of the substrate passed to the printhead) in order to generate corrected voltages 310 which are then passed to the printhead 1 for application by the charge electrode 7.

It is necessary to correct the preset voltages to take account of the effect of other printed droplets making up the character or characters in the row or rows of print laid down. The broad principle on which the current correction system is based is that of calculating the electrostatic and aerodynamic effect of each drop for all possible drop positions.

The first example (FIGS. 1 and 4 to 7) described above is adapted for single line printing and because there is a predetermined character set, the corrections for each drop due to aerodynamic effects can be predetermined and thus, for simplicity the corrections are pre-calculated for each printed drop of each printable character and are held in the character shape memory 211. Where the character set is not predetermined or where multiple lines of characters may be printed and thus the number of predetermined combinations of printed drop positions is exceedingly large, the correction is preferably carried out in real time. This avoids having to have a very large and thus expensive memory.

The resolution of the digital-to-analogue converter conventionally used in the head driver, limits the number of possible droplet charging voltages, and thus the number of possible droplet positions, to 256. On generation of each drop its effect on these 256 positions is calculated in the manner described below.

The charge voltage applied to a given drop n to place that drop at the correct position is given by the definition:

$$V_n' = V_n - F.C_V^n + 0.09V_{n-1}$$

where: $V_n$ is the preset value of the voltage for placing the drop n at the required position;

$V_n'$ is the corrected voltage actually used to charge the drop n;

F is a user adjustable factor related to the density of the printed drops;

$C_v^n$ is the element of a variable array corresponding to the preset voltage $V_n$; and $V_{n-1}$ is the voltage used to charge the preceding drop.

Once the drop n has been charged by the voltage $V_n'$, the elements of the array variable $C_v^n$ have to be recalculated. For each allowable charging voltage V (from 0 to 255):

$$C_v^{n+1} = C_v^n(1 - r|x|) + d_x.r_{|x|}$$

where x is a variable defined by $x = V_n - V$, ie. x is related to the relative displacement of the next drop (which would be charged by voltage V) to the previous drop charging voltage $V_n$;

$r|x|$ is equal to a partial correction $10/(10+|x|)$; and $d_x$ is an element of an array D constructed empirically to model the aerodynamic interaction between drops.

The array element CV, is first read from a lookup table which, for clarity, is represented by FIG. 10, showing the correction voltages for drops to be printed prior to and after a given printed drop.

Figure 11:
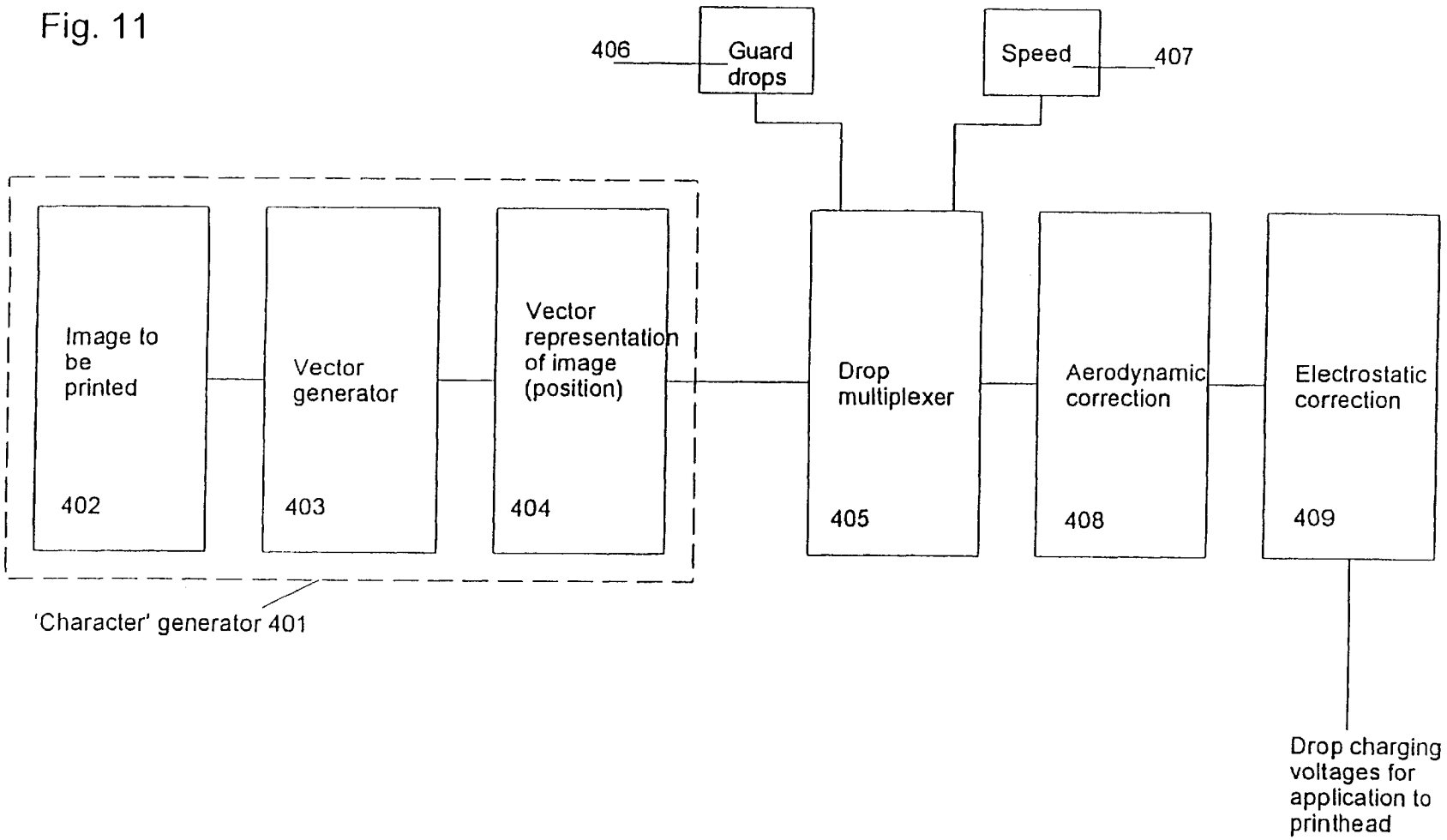
FIGS. 11 to 13 are illustrations of the techniques which may be employed for correction of the drop charging voltages.

Correction for aerodynamic and electrostatic effects can be performed in a number of different ways. FIG. 11 illustrates the broad concept, utilising a character generator 401 which includes selection of an image to be printed 402, a drop vector position generator 403 and a memory 404 for storing a vector representation of the image (character) to be printed. From the character generator 401, the data is passed to a drop multiplexer 405 to which guard drop data 406 and speed data 407 are fed. Aerodynamic correction 408 and electrostatic correction 409 are applied and the output is the drop charging voltages for application to the printhead.

Figure 12:
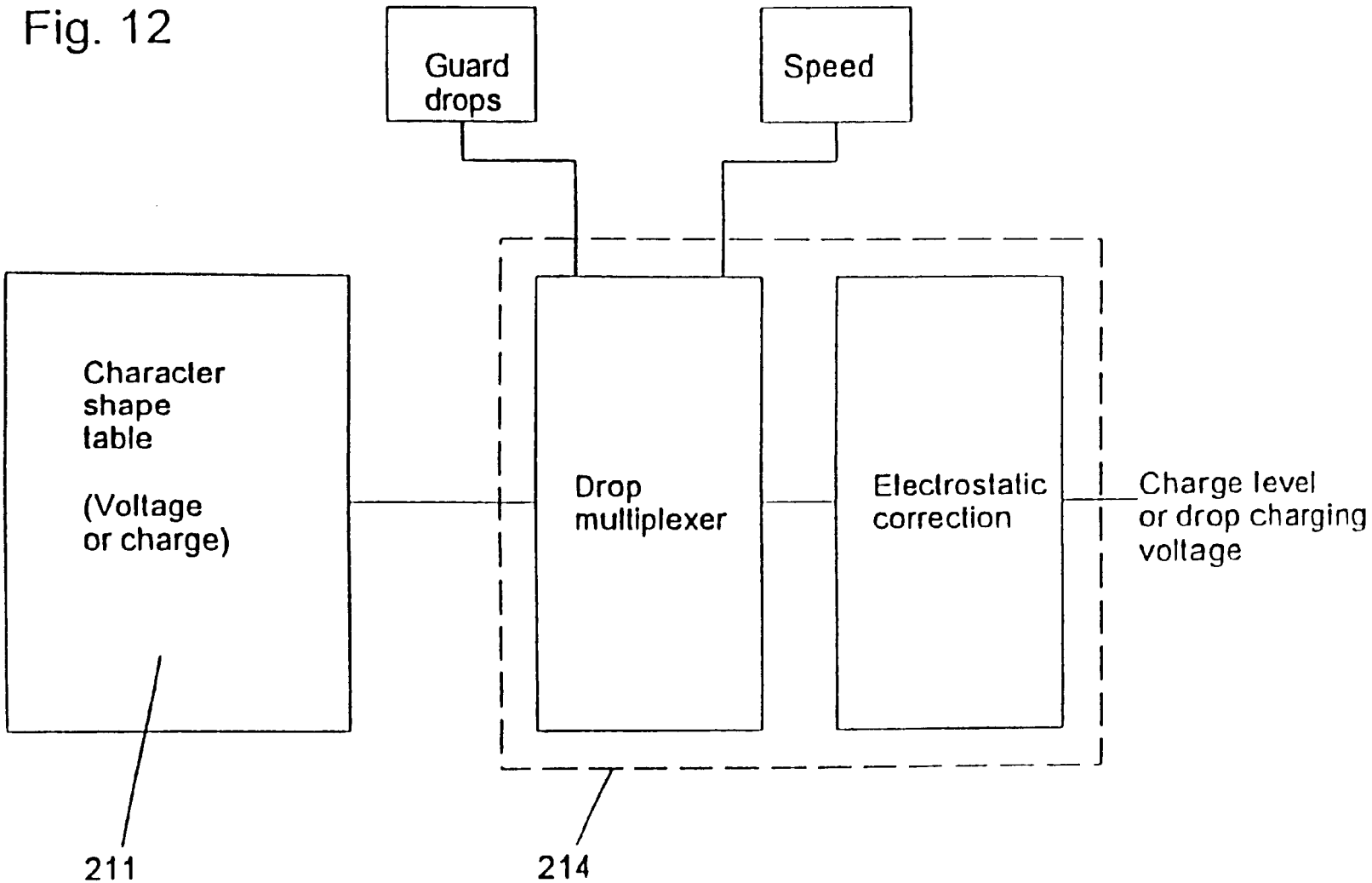

Character generation can be offline and used to create look-up tables which may have the aerodynamic correction built in as illustrated in the first example (FIG. 5) above. FIG. 12 illustrates this in simplified form.

Figure 13:
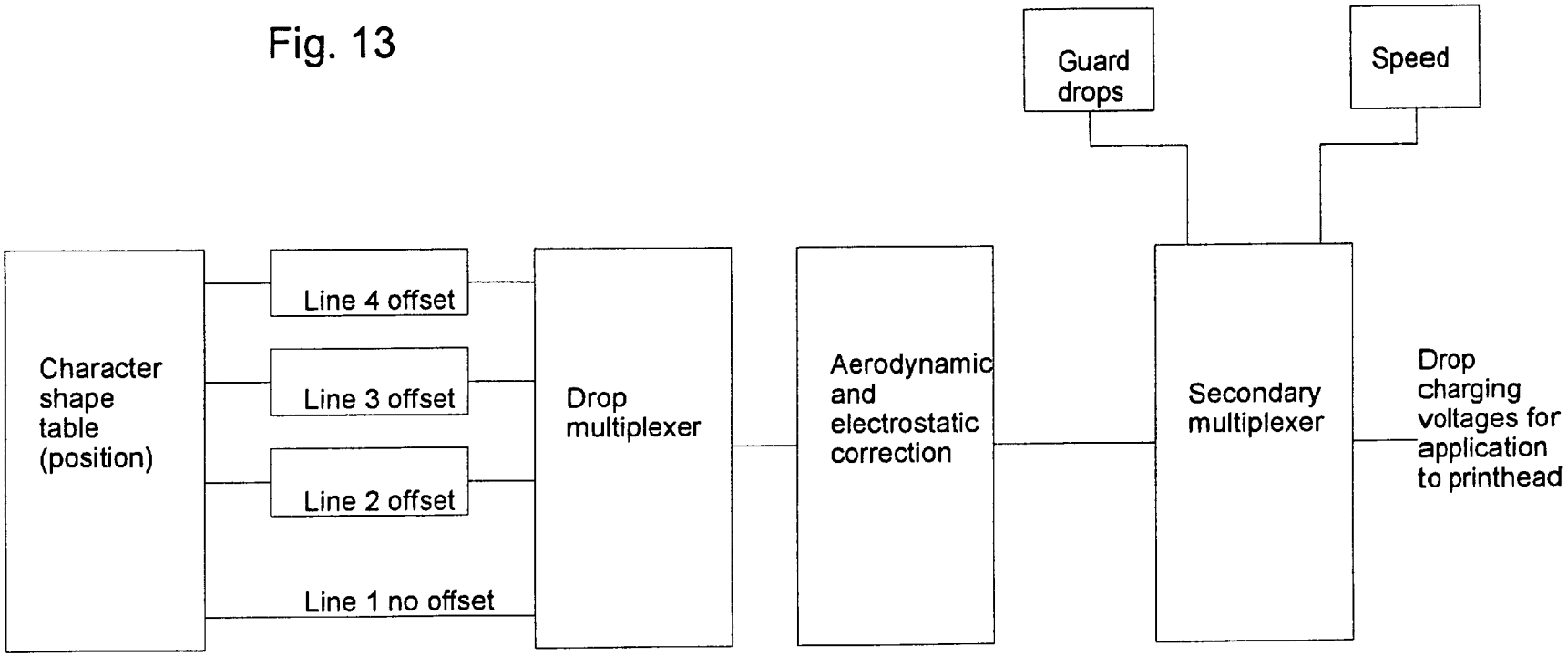

In the case of multiple lines of print being required, either character shape tables can be utilised or else a respective offset for each line can be applied to a single character table, in which case, the speed and drop multiplexer can be split as shown in FIG. 13.

What is claims is:

1. A continuous ink-jet printing method comprising providing a stream of droplets from a nozzle of a continuous ink-jet printhead;

moving a print substrate past the printhead, said printhead having a pair of deflection electrodes for deflecting individual charged droplets from said stream of droplets to a required print position on the substrate;

disposing said deflection electrodes at a preselected angle relative to the path of movement of said print substrate;

determining, in accordance with said deflection electrode angle, for each of a series of droplets to be printed on said substrate to form an image, the value of the charge to be applied to the droplet by looking-up the value from a memory containing values representative of the vector position of each droplet of each printable character and said values are charge values for each droplet;

determining the speed of movement of the print substrate relative to the printhead;

correcting the values of the charges to be applied to the droplets in said stream and adjusting the number of uncharged droplets between printable droplets in accordance with the determined speed of the substrate, the correction of the values of the charges to be applied to each of the droplets in the stream is carried out by predetermining corrected values due to aerodynamic effects for each character to be printed and storing them in a memory and the correction is carried out by correcting the values after they are read from the memory and; and applying the respective charges to each of the droplets in turn.

2. The method of claim 1 wherein said values are position vectors.

3. The method according to claim 1 wherein the speed of the substrate is predetermined.

4. The method according to claim 1 wherein the speed of the substrate is determined by sensing the actual movement of the substrate.

5. The method of claim 1 wherein multiple lines of characters are printed using individual look-up tables or memories for each line of print and the correction of the values of the charges to be applied to the droplets in the stream is carried out by correcting the values after multiplexing of the look-up table values.

6. The method of claim 1 wherein multiple lines of characters are printed using a single look-up table or memories for all lines of print, voltage offsets being applied to the charge values from the drops of each character according to the line in which the character is to be printed, and the correction of the values of the charges to be applied to the droplets in the stream is carried out by correcting the values after multiplexing of the charge values.

7. A continuous ink-jet printer comprising means for providing a stream of droplets from a nozzle of a continuous ink-jet printhead;

means for applying a charge to individual ones of the droplets;

a pair of deflection electrodes for deflecting individual charged droplets from the stream of droplets to a required print position on a substrate moving past the printhead, said deflection electrodes being disposed at a preselected angle relative to the path of movement of said substrate;

means for determining, in accordance with the deflection electrode angle, for each of a series of droplets to be printed on the substrate to form an image, the value of the charge to be applied to the droplet and including one or more memories containing values representative of the vector position of each droplet of each printable character, whereby the value of the charge to be applied to each droplet to be printed is determined;

means for setting a predetermined substrate speed into said printer;

means for sensing the actual movement of the substrate;

means for determining the speed of movement of the print substrate relative to the printhead; and means for correcting the values of the charges to be applied to the droplets in the stream immediately prior to the charging signals being fed to the printhead and after they are read from the memory or memories and adjusting the number of uncharged droplets between printable droplets in accordance with the determined speed of the substrate.

8. The printer of claim 7 wherein said values are position vectors.

9. The printer of claim 7 for printing multiple lines of characters, comprising individual look-up tables or memories for each line of print, a multiplexer for multiplexing of the look-up table values, and means for correcting the values of the charges to be applied to the droplets after multiplexing.

10. A continuous ink-jet printer comprising a continuous ink-jet printhead having a nozzle for providing a stream of droplets;

a drop charger to apply a charge to individual droplets a pair of deflection electrodes for deflecting individual charged droplets from the stream of droplets to a required print position on a substrate moving past the printhead, said deflection electrodes being disposed at a non-perpendicular angle relative to the path of movement of said substrate, a drop charger controller connected to said drop charger to have said drop charger apply a charge to selected printable droplets and no charge to other preselected droplets to provide uncharged droplets, a speed detector to detect the speed of substrate relative to the printhead, said speed detector connected to said drop charger controller, said drop charge controller determining, in accordance with the deflection electrode angle, for each of a series of droplets to be printed on the substrate, the value of the charge to be applied to the droplet, and said drop charge controller adjusting the number of uncharged droplets between printable droplets in accordance with the determined speed of the substrate.

11. The printer of claim 10, wherein;

the angle $\alpha$ of the deflection electrodes to the path of movement of the substrate is chosen depending on the number of droplets N required to print a line normal to the path of movement of said substrate, by the equation:

$$\tan \alpha = \frac{n+1}{N}$$

where: n is the minimum number of non-printable droplets between adjacent printable droplets in a line of droplets normal to the path.

* * * * *